US009540209B2

(12) United States Patent
Barea

(10) Patent No.: US 9,540,209 B2
(45) Date of Patent: Jan. 10, 2017

(54) POSITIVE FEEDER DEVICE FOR FEEDING METAL WIRES AT CONSTANT TENSION

(71) Applicant: BTSR INTERNATIONAL S.P.A., Olgiate Olona (Varese) (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 344 days.

(21) Appl. No.: 14/353,728

(22) PCT Filed: Oct. 29, 2012

(86) PCT No.: PCT/IB2012/002180

§ 371 (c)(1),
(2) Date: Apr. 23, 2014

(87) PCT Pub. No.: WO2013/064879

PCT Pub. Date: May 10, 2013

(65) Prior Publication Data

US 2015/0014465 A1 Jan. 15, 2015

(30) Foreign Application Priority Data

Nov. 2, 2011 (IT) ..... MI2011A1983

(51) Int. Cl.
*B65H 59/38* (2006.01)
*B21C 47/34* (2006.01)
(Continued)

(52) U.S. Cl.
CPC ..... *B65H 59/388* (2013.01); *B21C 47/003* (2013.01); *B21C 47/345* (2013.01); *B65H 59/18* (2013.01);
(Continued)

(58) Field of Classification Search
CPC ... B65H 59/388; B65H 59/18; B65H 2701/36; B21C 47/003; B21C 47/345; H01F 41/094
See application file for complete search history.

(56) References Cited

U.S. PATENT DOCUMENTS 3,637,149 A 1/1972 Frei
3,796,385 A 3/1974 Jacobsson
(Continued)

FOREIGN PATENT DOCUMENTS

CN 1071212 A 4/1993
CN 1544884 A 11/2004
(Continued)

OTHER PUBLICATIONS

Chinese Office Action dated Aug. 27, 2015,comments and search report, in corresponding Chinese patent application No. 201280054103.5.
(Continued)

*Primary Examiner* — William E Dondero
(74) *Attorney, Agent, or Firm* — Vorys, Sater, Seymour and Pease LLP

(57) ABSTRACT

A metal wire feeder device including a body presenting a wire braking member, one or more pulleys driven by respective motors about which the wire is wound, the wire before reaching a processing machine passing through a compensator member and a tension sensor, an electronic control unit able to continuously measure the tension value and make it uniform at a predetermined value by acting on a first regulator loop operating on the motors and a second regulator loop operating on the compensator member. The electronic control unit operates automatically in making the tension uniform at the predetermined value, on the basis of the fed wire quantity or of the wire feed velocity.

15 Claims, 3 Drawing Sheets

(51) Int. Cl.
*B65H 59/18* (2006.01)
*B21C 47/00* (2006.01)
*H01F 41/06* (2016.01)

(52) U.S. Cl.
CPC ..... *H01F 41/094* (2016.01); *B65H 2701/36* (2013.01)

(56) References Cited

U.S. PATENT DOCUMENTS

| | | | |
|---|---|---|---|
| 3,843,069 | A | 10/1974 | Deniega et al. |
| 3,883,083 | A | 5/1975 | Rosen |
| 4,180,215 | A | 12/1979 | Nurk |
| 4,852,617 | A | 8/1989 | Hamer et al. |
| 4,913,374 | A | 4/1990 | Gerest |
| 5,092,534 | A | 3/1992 | Tanaka |
| 5,240,194 | A | 8/1993 | Noirot et al. |
| 5,421,534 | A | 6/1995 | Arnold et al. |
| 5,423,197 | A | 6/1995 | Roser |
| 2008/0210804 | A1 | 9/2008 | Barea |
| 2008/0296425 | A1 | 12/2008 | Comotto et al. |
| 2009/0178757 | A1 | 7/2009 | Cocovi et al. |
| 2012/0037601 | A1 | 2/2012 | Watanabe et al. |

FOREIGN PATENT DOCUMENTS

| | | | |
|---|---|---|---|
| DE | 4104087 | A1 | 8/1991 |
| DE | 4313255 | A1 | 10/1994 |
| DE | 102004020465 | B3 | 9/2005 |
| EP | 0424770 | A2 | 5/1991 |
| EP | 0652312 | A1 | 5/1995 |
| EP | 2014809 | A1 | 1/2009 |
| EP | 2031610 | A1 | 3/2009 |
| FR | 2655888 | A1 | 6/1991 |
| JP | S64034873 | A | 2/1989 |
| JP | H05105328 | A | 4/1993 |
| JP | H06310353 | A | 11/1994 |
| JP | 2001328766 | A | 11/2001 |
| JP | 2006225051 | A | 8/2006 |
| JP | 2009501116 | A | 1/2009 |
| WO | 2006133662 | A1 | 12/2006 |
| WO | 2007006411 | A1 | 1/2007 |
| WO | 2007048528 | A1 | 5/2007 |
| WO | 2007096765 | A1 | 8/2007 |
| WO | 2010116412 | A1 | 10/2010 |
| WO | 2013/072736 | A1 | 5/2013 |
| WO | 2013/088233 | A1 | 6/2013 |
| WO | 2013/093592 | A1 | 6/2013 |
| WO | 2013/098631 | A1 | 7/2013 |

OTHER PUBLICATIONS

Japanese Office Action dated Sep. 8, 2015 in corresponding Japanese patent application No. 2014-539417.

U.S. Appl. No. 14/353,806 to Tiziano Barea, "Yarn Feeder of Storage Type With Magnetic Brake," filed Apr. 24, 2014. (US National Stage of WO 2013/072736 A1).

U.S. Appl. No. 14/353,867 to Tiziano Barea, "Device for Feeding Yarn to a Textile Machine," filed Apr. 24, 2014. (US National Stage of WO 2013/088233 A1).

U.S. Appl. No. 14/354,211 to Tiziano Barea, "Method and Device for Storing Yarn in Order to Feed Thread Without Creating Twisting Thereof," filed Apr. 25, 2014. (US National Stage of WO 2013/093592 A1).

U.S. Appl. No. 14/354,279 to Tiziano Barea, "System and Method for Feeding Metal Wires at Constant Tension," filed Apr. 25, 2014. (US National Stage of WO 2013/098631 A1).

International Search Report mailed Apr. 4, 2013 for PCT/IB2012/002180 to BTSR International S.P.A. filed Oct. 29, 2012.

POSITIVE FEEDER DEVICE FOR FEEDING METAL WIRES AT CONSTANT TENSION

CROSS-REFERENCE TO RELATED APPLICATIONS

This is a §371 National Stage Application of International Application No. PCT/IB2012/002180 filed on 29 Oct. 2012, claiming the priority of Italian Patent Application No. MI2011A001983 filed on 2 Nov. 2011.

The present invention relates to a wire feeder device as described in detail below.

Numerous industrial processes are known (electric motor manufacture, coil construction, etc.) in which a metal wire has to be wound on a physical support which can have different shapes, be formed from different materials and either form part of the finished product or be used only during the production stage (as in the case of those coils known as "coils in air" formed with wire which self-adheres with temperature).

In these processes, tension control is fundamental to ensure constancy and quality of the finished product. For example, correct tension control ensures the formation of high quality square coils by making the wire adhere precisely to the support, even in proximity to the corners present on the support, to avoid that known colloquially as a "soft coil".

The tension applied to the coil can also, for example, cause wire elongation, causing a reduction in its cross-section and consequently in the specific electrical resistivity ρ and hence in the impedance of the finished product (e.g. ρ×wirelength=specific resistance).

Tension control is particularly important during the initial stage in the production of a coil, the stage in which the wire is wrapped about terminals (wrapping stage) to which it will then be welded to cause it to adhere perfectly to these latter and prevent it from breaking. Moreover during a winding process carried out on an automatic machine, the successive winding of two different coils comprises a stage in which an already completed coil, or rather the support on which the wire has been wound, is unloaded and a stage in which the new support is loaded to commence the winding and arrangement of a new coil. This operation can take place manually (by an operator) or automatically, by generally cutting the wire and mechanically moving an arm on which the support with the already wound wire is fixed (stage indicated hereinafter as the loading stage). During this latter stage it is important to control the wire tension such that no slackness forms, and which could for example cause problems on starting the next production stage.

The normal tension application range varies from 5 to 4000 cN, depending on the wire diameter; evidently the smaller the wire diameter the lower is the working tension, and the greater the importance of controlling the tension during the winding stage.

Various types of feeder devices (or simply feeders) specific for metal wires are known which enable said control.

A first type of such devices comprises completely mechanical feeders in which a main body is present on which a wire brake (generally of felt pad type) is fixed, its purpose being to stabilize the wire originating from the spool, clean it of the paraffin generally present on the wire and feed it to the tensioning member. This tensioning member is generally formed from a movable arm hinged at one end to a body of the feeder and subjected to is springs for return to a rest position. The purpose of this arm is to maintain the wire tension constant during its unwinding and to ensure its take-up when required by the implementation of the process (in the support change-over stage).

These feeders present various drawbacks. Firstly, as the tension of the metal wire is generally regulated by one or more springs which cooperate with the tensioning arm, the tension regulating device must be adjusted manually and controlled position by position during the entire process. In this respect, this device represents an "open loop system" which is unable to correct any errors arising during the process (change in the inlet tension of the metal wire originating from the spool, damage or decalibration of one of the springs, dirt accumulation within the entry wire brake, etc.).

In addition, in a feeder of the aforesaid type a single working tension is set and there is hence no possibility of setting different tensions for the wrapping stage, for the working stage and for the loading stage.

This set tension also depends on the winding velocity, as it is partly the result of a friction tension which in its turn is a function of said velocity; for this reason large tension variations occur in the machine acceleration and deceleration stages.

These tension variations negatively affect the final product quality, also causing a variation in the resistive value and impedance of the wound wire.

Finally, as the tension applied to the wire is generated by a spring leverage acting on the movable arm, it is impossible to have a single device able to satisfy the entire range of tensions with which generic metal wires are fed to a processing machine. Hence either several feeder devices are required or a part of them (for example the springs) have to be mechanically modified in order to be able to work any type of wire.

Electromechanical devices or feeders are also known which in contrast to purely mechanical devices have an electric motor to which a rotating pulley is fixed about which the wire originating from the spool, after passing through the felt pad wire brake, winds for at least one turn before encountering a movable mechanical arm similar to that of mechanical feeders.

Springs acting on the movable arm are present together with a electronic control unit which, in addition to controlling the motor operation, is able to measure the position of this arm. Depending on said position, this unit increases or decreases the motor velocity and consequently the wire feed velocity, in practice using the arm itself as a command for accelerating and braking.

These feeders also present the limits of the aforesaid strictly mechanical devices as they use the movable arm to tension the wire and work on "open loop" without real control of the final product. Finally, electronic braking devices are known which, in addition to the movable take-up arm, also comprise a load cell (or other equivalent tension measurer) positioned at the feeder outlet, with a device control unit using the measured tension value to regulate pre-braking generally upstream of the compensator arm. Such a solution is described for example in EP 0424770.

Even if this solution solves some problems of the previously stated devices, it still presents various limits, for example the wire tension is generated and controlled by acting on a rotary braking member. The device hence operates as a closed loop but is not able to feed the wire at a tension less than the spool unwinding tension as this member can only brake the wire and hence increase this tension.

Moreover as the velocity of the processing machine processing the wire increases, the input tension of the wire into it also increases because of friction. Hence, in particular with small diameter metal wires (capillary wires) for which the working tension is generally very low, with this type of feeder the feed velocity must generally be low to prevent wire breakage and ensure its desired minimum working tension; in fact, in this solution the input tension must always be less than the output tension.

Another prior patent, U.S. Pat. No. 5,421,534, describes another feeder of the aforesaid type in which rotary members feed the wire and brake it in its movement. The described solution has drawbacks similar to those of the device the subject of EP424770 and is more complex than this latter. Moreover the US patent does not describe the use of a compensator arm.

FR 2 655 888, DE 10 2004 020465 and U.S. Pat. No. 5,421,534 describe various wire feeder devices. However, the know solutions do not describe a device for feeding metal wires in which this feed can take place, under controlled constant tension, in a completely automatic manner, by measuring wire parameters (quantity of wire fed and velocity) during its feed. In other words, the wire feed in said prior patents does not take place by means of automatic feeder operation via the measurement made by this latter on the aforesaid wire parameters.

An object of the present invention is to provide a device which is able to feed a metal wire while measuring its tension and making it uniform (by decreasing or increasing it) at a possibly programmable predetermined value, by a closed loop control of the feed. In this manner, the device is able not only to brake the wire, but also to feed it at a tension less than (and not only greater than) that at which the wire unwinds from a corresponding originating spool.

Another object of the present invention is to provide a device in which either a single wire feed tension can be set for the entire process to which it is subjected, or a different tension to achieve different tensions in different operative stages of the machine (wrapping, working, loading), all in a totally automatic manner or by interfacing with the machine.

A further object of the present invention is to provide a device able to also operate, while offering optimal performance, on processing machines already present on the market and hence without any type of specific interfacing with these latter, said device acting on the wire on the basis of operative characteristics corresponding to the various operative stages of such machines, but without being necessarily connected to these latter and without receiving command signals therefrom.

Another object of the present invention is to provide a device which is highly dynamic, in the sense of being able to respond instantly to velocity variations of the processing machine and to the different tension settings of this latter (for example, on the basis of different wire working stages), to hence optimize feed control during the changeover stages of the operative process (passage from wrapping tension to working tension, velocity ramps, etc.).

Another object of the present invention is to provide a device which while having the wire tension perfectly under control, enables the machine velocity to be increased in particular with metal wires of particular characteristics, such as a capillary wire.

A further object of the present invention is to provide a single device able to operate with the entire range of metal wires and of the working tensions to which they are subjected.

Another object of the present invention is to provide a device able to feed the wire at high tension even at low velocities.

A further object of the present invention is to provide a device with which the quantity of metal wire fed to the processing machine can be measured with absolute precision.

Another object of the present invention is to provide a device able to monitor any wire breakage, sensed as a variation or absence of tension.

These and other objects, which will be apparent to the expert of the art, are attained by a feeder device in accordance with the accompanying claims.

The present invention will be more apparent from the accompanying drawings, which are provided by way of non-limiting example and in which.

Figure 2:
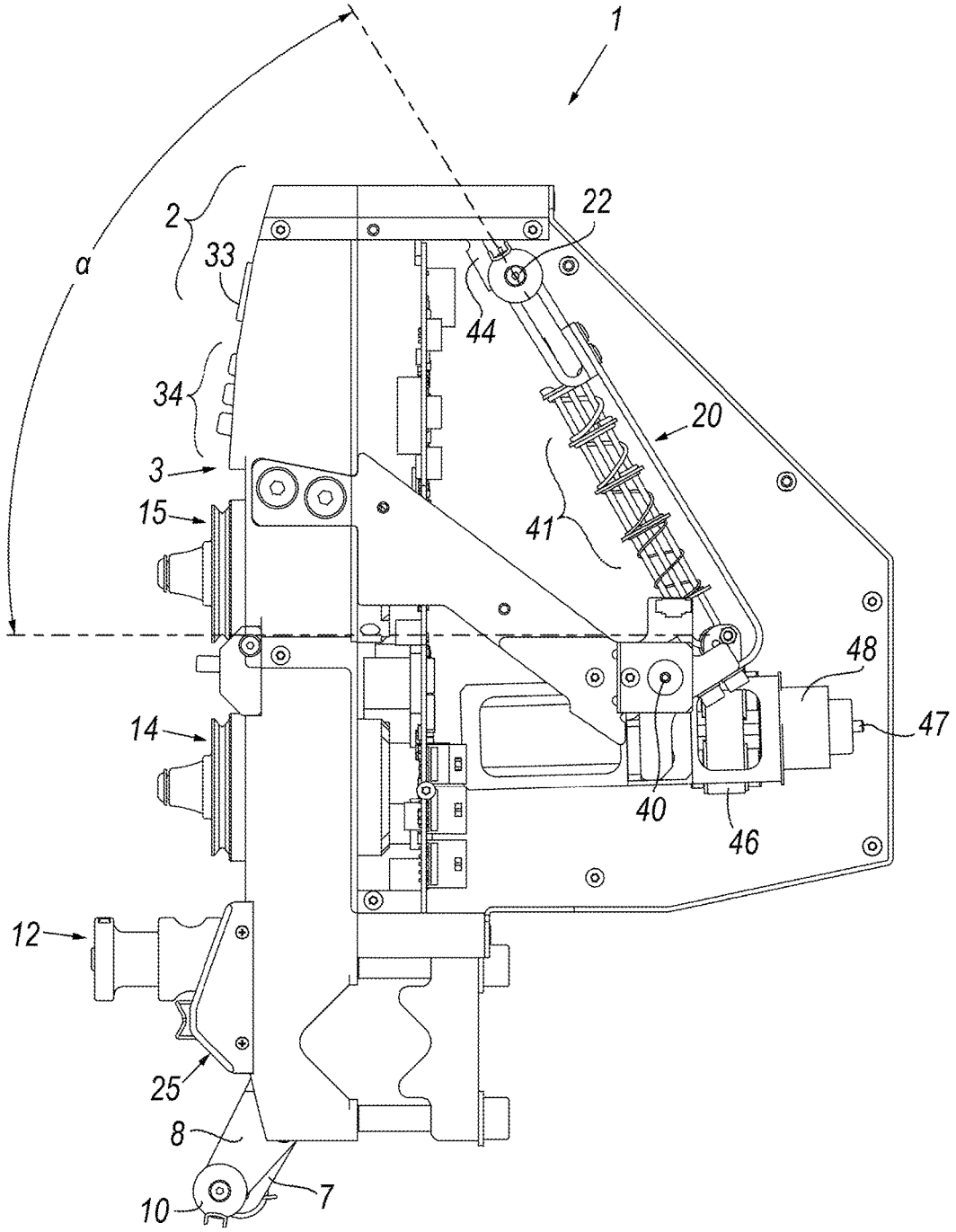
FIG. 2 is a view from the right of the device of FIG. 1, but with some parts removed for greater clarity.
Figure 3:
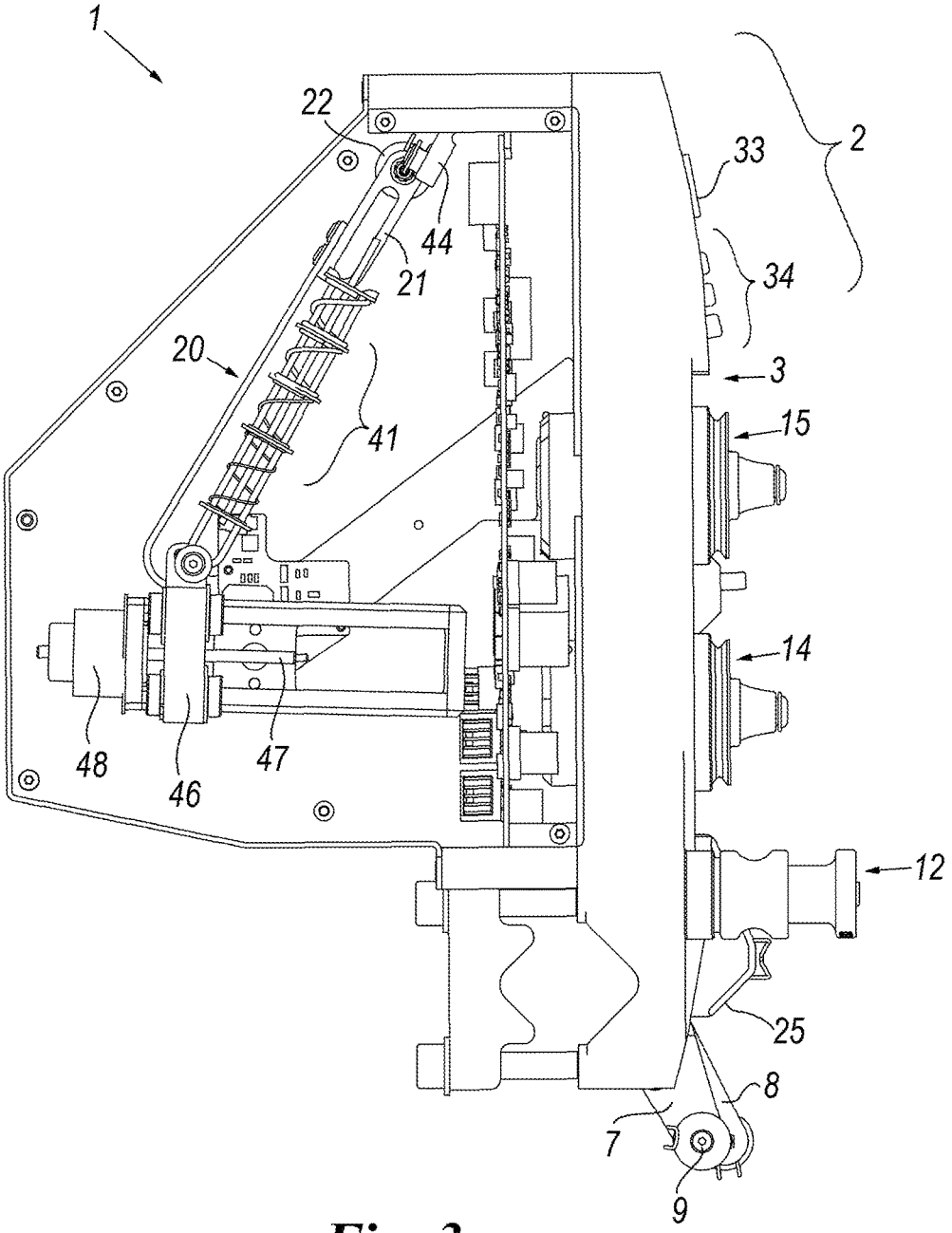
FIG. 3 is a view from the left of the device of FIG. 1, but with some parts removed for greater clarity.

With referenced to said figures, a metal wire feeder device is indicated overall by 1 and comprises a body or casing 2 having a front face 3 and lateral faces 4 and 5. These latter are closed by cover elements which are not shown in FIGS. 2 and 3 in order to give visual access to the interior of the body 2.

Figure 1:
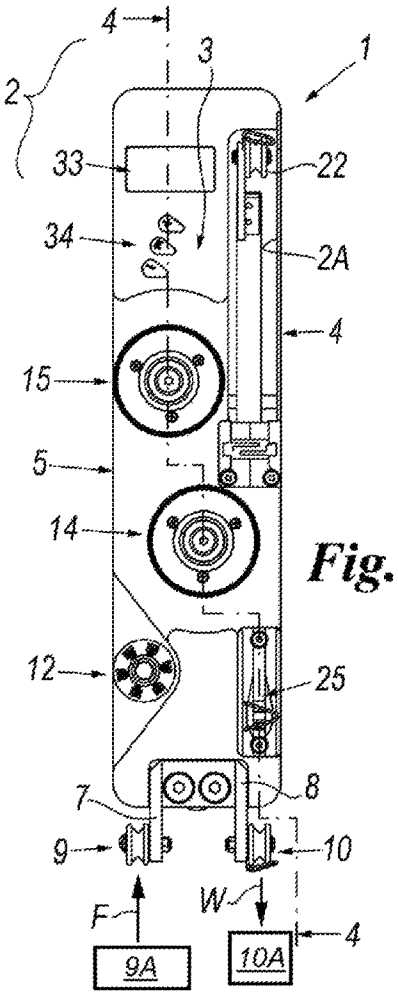
FIG. 1 is a front view of a feeder device according to the invention.

On the front face 3 or associated therewith and projecting from it, parallel supports 7 and 8 (starting from the bottom of the body 2 with reference to FIG. 1) are present, carrying a corresponding grooved roller 9 or 10 freely rotatable on a pin fixed to the respective support. The purpose of each roller 9, 10, preferably made of ceramic, is to define the wire trajectory from a spool 9A to the device 1 and from there to a processing machine 10A, for example a winding machine. These trajectories are respectively indicated by F and W. The fact that the rollers are of ceramic (or of equivalent low friction coefficient material) is to minimize the friction between the wire and roller, so minimizing the possibility of damage to the wire during contact.

The body 2 comprises a wire brake 12 with which the wire cooperates at its exit from the roller 9 and which has the task of stabilizing the wire entering the device and of cleaning it with usual felts (not shown) to remove any paraffin residues (originating from the previous wire drawing stage). On leaving the wire brake 12, this wire encounters a first pulley 14 about which it winds (for a fraction of a turn or for several turns) before passing onto a second pulley 15, both said pulleys being driven by their own electric motor 16 and 17 respectively, associated with the body 2 and controlled and commanded in its operation by a control unit 18 also associated with said body.

To this latter there is connected a movable take-up or compensator arm 20 presenting, at a free end 21, a passageway for the wire, preferably via a roller 22 (also of ceramic or the like), on which the wire leaving the pulley 15 (and passing through an aperture 2A of the body 2) arrives. This movable arm lies inside the body 2, behind the face 3 thereof.

From the roller 22 (or equivalent fixed passage member), the wire passes through the aperture 2A and then onto a tension sensor 25, for example a load cell, also connected to the control unit 18, from which it leaves to pass onto the roller 10 and be fed to the processing machine (arrow W).

The control unit 18 is able to measure wire tension via the sensor 25 and to modify the rotational velocity of the pulleys 14 and 15 by acting on the respective motors 16 and 17, and consequently to control and make uniform the wire tension at a predetermined value which is possibly programmable (for example on the basis of the various working stages to which the wire of the processing machine is subjected), and is set in the unit 18, which can be of microprocessor type and have a memory (or cooperate with a memory 19) in which one or more tension values, for example corresponding to the aforesaid working stages, are tabulated.

The preset tension value can be greater or less than the tension under which the wire unwinds from the spool.

The body 2 also carries a display 33 controlled by the unit 18, by which the device operative conditions (measured tension, set tension, feed velocity, etc.) are displayed. The working parameters are also shown on this display, and can be set by a keyboard 34.

The body 2 also comprises connectors (not shown in the figures) which enable the feeder to be electrically powered, and enable communication with the device via standard or proprietary buses (RS485, CANBUS, ETHERNET . . . ) in order to read its state (measured tension, velocity, any alarm conditions) or to programme its operation (working tension, working mode . . . ). This body also comprises a 0-10 Vdc input for programming the working tension in analogue mode and a run-stop input to indicate to the device whether the machine is in the working stage, and one or more digital inputs through which different working tensions can be programmed on the basis of the different machine operative stages (wrapping, working, loading . . . ).

The operation of the feeder device 1 will now be described in greater detail. During the use of this latter, the control unit 18 continually measures the wire tension via the tension sensor 25 and compares this measured value with a reference value (setpoint). Based on the difference between the measured tension and the set tension or setpoint, the control unit 18 acts on the motors 16 and 17 accelerating or decelerating them, in accordance with known P, PI, PD. PID or FOC (field oriented control) control algorithms, in order to make said measured tension value equal to the setpoint value.

It will be apparent that the device 1 is able to guarantee any set tension: in this respect, to guarantee this tension value the device does not use purely mechanical brakes (i.e. spring systems) or electromechanical brakes, but only the torque of the two motors 16 and 17 which drive the pulleys 14 and 15 on which the wire winds. In this manner the device is able to guarantee an exit wire tension which is greater or less than that present during the unwinding from the spool by controlling the velocity of the two motors 16 and 17. Hence without any regulation of mechanical type (for example, by changing the springs), the feeder 1 is able to guarantee any required set tension, to hence attain the object of having an applicational range (based on the wire diameter and consequently on the working tension, see Table 1) which is decidedly greater than all known solutions.

Moreover, as the set tension is merely a number and not a mechanical regulation (as in the case of known solutions), it is apparent that the device is able to modify this setpoint value on the basis of the various operative conditions to which the wire can be subjected.

The feeder device 1 can operate interfaced with the processing machine or completely automatically.

In the case of interfacing with the machine, there is communication between the machine and the device. By means of this communication the machine signals its operative state (i.e. the operative stage to which the metal wire is subjected) to the device 1 which consequently may modify the wire tension on the basis of the operative stage. Interfacing can take place for example via the 0-10 V analogue input, by which the machine intervenes in real time on the device 1 to generate the wire operative tension corresponding to the different working stages, hence attaining the object of having different tensions for the different operative stages.

Alternatively, interfacing can take place via digital inlets of the device 1 corresponding to different operative tensions, programmed for example within the unit 18 or via the serial bus. Hence by activating the different inlets (for example a binary code) the machine activates different operative tensions, to thus attain the object of achieving different tensions for the different operative stages.

In another variant, the machine can be connected to the device 1 by a serial interface so that, by means of a standard or proprietary fieldbus, the machine intervenes in real time on the device 1 to regulate the wire working tension, hence attaining the object of achieving different tensions for the different operative stages.

Finally, the machine can be connected to the device 1 via a sync inlet of this latter. In this working manner the control unit 18 receives synchronisation pulses from the machine (for example one at each revolution of a rotary member or at each winding of the wire about a support) and consequently varies the wire working tension (in accordance with a pre-established profile), for example at each synchronisation pulse.

In the case of automatic mode operation, the device has no direct interfacing with the machine, and the change between the different applicational conditions (i.e. between the different wire tensions) takes place completely automatically. In addition to knowing the tension measured via the sensor 25, the control unit 18 as stated also controls the velocity of the motors 16 and 17 and consequently knows its value instant by instant. This velocity and consequently the fed wire quantity is measured in known manner, for example by analyzing the state of common hall sensors or of an encoder which are connected to each motor or internal to the motor. In one embodiment, the control unit 18 acts in one of the two following ways: by evaluating (and controlling) the tension on the basis of the fed wire quantity, or by evaluating (and controlling) the tension on the basis of the wire feed velocity.

In the first working mode, the control unit 18 uses for example the sensors associated with each motor 16 and 17 not to measure their velocity, but to measure the fed wire quantity (considered as the number or fraction of revolutions of the pulley 14 or 15 connected to the motor 16 or 17, on which the wire winds). The unit 18, on the basis of data present in the memory with which it cooperates, knows the variation in the tension as a function of the wire fed and controls it in consequence. For example, the unit 18, by means of a profile of programmed working tensions, knows that the first 10 mm of wire have to be fed at a tension of 15 grams, the next 400 mm have to be fed at a tension of 100 grams, the next 10 mm at a tension of 15 grams and so on, until the termination of the productive process.

Hence in a totally automatic manner the device 1, by simply measuring the fed wire quantity, is able to change the wire operative tension, in accordance with a profile or sequence of working tensions, to better adapt the feed to the different machine operative stages.

In the second working mode (tension control as a function of the wire feed velocity), the control unit 18 uses the sensors associated with each motor 16 and 17 to measure their velocity. This unit, on the basis of memorized data which relate this measured value to the tension, controls this tension. The unit associates different working tensions with each velocity range: for example for velocities between 0 and 10 meters/minute the wire is fed at 15 grams, whereas if the velocity passes into the range 10-100 meters/minute the wire is fed at 100 grams. Obviously, the relationship between the feed velocity and the tension depends on the physical characteristics of the metal wire and on the process to which it is subjected.

It is therefore evident that by simply measuring the rotational velocity of each motor 16 and 17, the device is able totally automatically to change the wire operative tension in order to better adapt the wire feed to the different machine operative stages. It should be noted in fact that a machine operating on a metal wire generally provides for at least two separate feed velocities, at least for the wrapping stage (critical process carried out normally at low velocity) and the working stage in which it is sought to utilize the maximum winding velocity of the machine.

Hence the device according to the invention therefore adapts perfectly to working both with machines in which "communication" is provided between the device itself and the machine, and with machines already present on the market, in both cases succeeding in attaining the objects of the present invention and in particular ensuring that different tensions can be achieved under the different operative conditions. This enables for each operative stage the most appropriate tension to be set and consequently to maximize the machine effectiveness in terms of efficiency, quality and velocity of production (wire winding).

Figure 4:
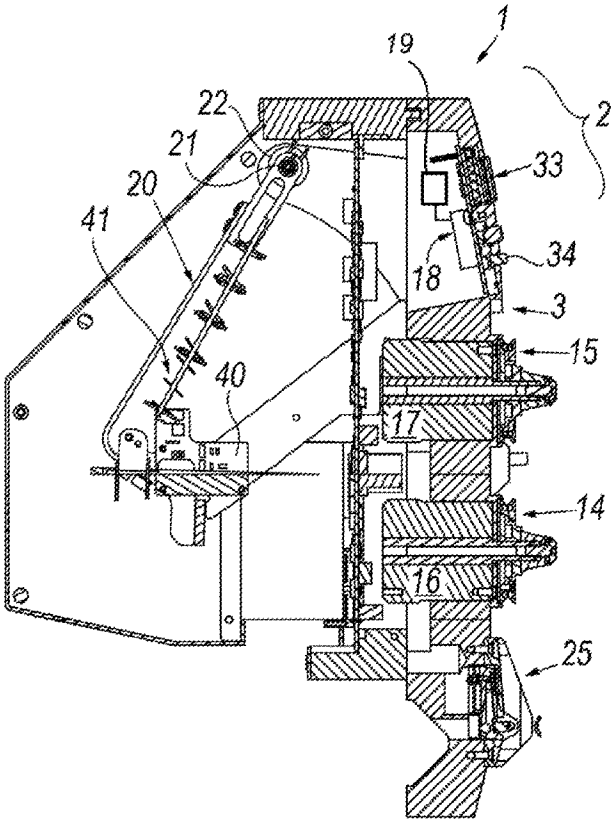
FIG. 4 is a section on the line 4-4 of FIG. 1.

As stated, the device 1 also comprises (see FIGS. 2-4) a compensator arm 20 free to rotate about a pin 40 fixed on a bracket 41 associated with the body 2. Hence, this arm can move within the body 2 through a predefined angular sector $\alpha$ (see FIG. 2) towards or away from the tension sensor 25. Associated with the compensator arm 20 there is a spring 41 (shown interrupted in FIGS. 2-4) connected at one end to a support 44 fixed to the device body 2 and at the other end to the compensator arm 20 via a movable carriage 46 driven by a stepping motor 48 via a (Archimedes) worm 47.

A position sensor (not shown), connected to the control unit 18, is associated with the compensator arm 20 to measure its position within the sector $\alpha$.

The compensator arm 20 is hence able to oppose the sliding of the wire not in a static but in a dynamic manner: in fact the control unit 18 can vary the position of the carriage 46 (by acting on the motor 48) to which the spring 41 is connected, to obtain a variation of the force exerted by this latter on the arm 20 and bring this latter into the required position within the sector $\alpha$. In this manner the arm 20 maintains the wire always perfectly taut on the load cell or tension sensor 25, in particular during the stages in which the wire is not fed to the machine (loading stage). The fact of being able to vary the force of the spring 41 hence enables the value of said tension to be regulated, so attaining the object of differentiating the working setpoint for this stage relative to that in which the wire is effectively fed.

The arm 20 also creates a reserve of metal wire from which the machine can draw during sudden velocity changes; in such a case the arm 20 moves from a first position $\alpha 1$ to a second position $\alpha 2$ within the sector $\alpha$ while waiting for the motor to attain the correct feed velocity. The presence of the arm 20 hence overcomes the dynamic limits given by the acceleration time of each motor 16 and 17, so enabling the wire tension to be maintained under control even during the machine velocity changes (acceleration), said tension hence always being made uniform at the required setpoint.

The arm 20 hence defines a second tension control loop comprising also the sensor 25 and the unit 18, this second loop being added to the first loop defined by the motors 16 and 17, the sensor 25 and the unit 18.

The arm 20 also enables any wire excess to be taken up during the machine deceleration stage in passing from the second working position $\alpha 2$ to the first position $\alpha 1$ within the sector $\alpha$. The presence of the arm hence overcomes the dynamic limits given by the deceleration time of the motor, hence also in this case enabling the tension to be maintained under control during the machine velocity changes (deceleration), this tension always being made uniform at the required setpoint. This function also falls within the scope of the second regulation loop.

The presence of the compensator arm 20 hence enables the device 1 to increase its dynamicity not only in the machine acceleration and deceleration stages but also under all those conditions in which more or less high absorption discontinuities are present, such as when forming square coils.

The invention also enables a position of the arm 20 to be programmed which better adapts to the particular operative condition and which is independent of the working tension.

In this respect the control unit 18, by knowing the position of said arm, can vary the force of the spring 41 to bring the arm into the desired position, for example by making the arm always lie at the centre of the angular sector $\alpha$, hence ensuring for the device an equal "stock" of wire for possible accelerations and decelerations of the machine.

The device of the invention is hence able to control the wire tension value in any operative stage of the processing machine, whether during the feed stage or at rest, and to make it uniform at a possibly programmable predetermined value; it is also able to monitor (without any interfacing with the machine) the presence of the wire and/or its absence (breakage). The control unit 18 continuously verifies that the measured tension is within a range (preferably programmable) in the region of the working tension which is required and necessary for that particular operative stage. As soon as this unit senses that the measured value lies outside said range and remains there for a predetermined time (preferably programmable), it signals this irregularity (for example visually and/or acoustically by known signalling means) and activates an alarm by which the machine or independent machine section connected to the device is halted.

Various characteristics of the invention have been described; others are however possible. For example, the device can be formed with a single motor 16 or 17 of suitable torque to optimize space and costs.

The device could be formed with a motor developed as described in EP2080724 in the name of the same applicant, in order to obtain high torques even at low velocities.

Moreover, as the operative conditions of the feeder device vary, dictated by the different machine operative stages, not only can a different operative tension be associated therewith, but also other settings, for example the coefficients of the P, PI, PD. PID or FOC (field oriented control) algorithms, or the enabling/disabling of certain different functions such as the recognition of a broken wire, or others.

Moreover, the spring 41 used as an opposition force for the compensator arm 20 instead of being only a simple single spring could comprise a plurality of springs of different elastic constants (to define a spring with gradual compression) in which each spring is able to work on different consecutive tension ranges. Hence with a single spring a wider applicational range is obtained with a greater regulation fineness.

Finally, the device 1 can comprise at least one pulley 14 (or 15) with a corresponding motor 16 (or 17) controllable in two different and opposite directions of rotation such as to enable wire feed and excess take-up, for example during the loading stage.

These variants are also to be considered as falling within the scope of the ensuing claims.

The invention claimed is:

1. A feeder device for receiving metal wires unwinding from a corresponding spool and feeding the received metal wires to a processing machine at a desired tension, the feeder device comprising:

a body having a wire braking member, a tension sensor associated with the body for measuring tension of the wire being fed by the feeder device to the processing machine, an actuator associated with the body, at least one rotary member driven by the actuator, and about which the metal wire winds for a fraction of a turn or for several turns, to feed the wire to the processing machine at a tension which is a function of drive torque generated by the actuator rotating the rotary member, the tension being regulated to be maintained within a region of a predetermined and/or programmable reference value and be increased or decreased if needed to return the tension to the region, a control unit for controlling the movement of the actuator connected to the tension sensor, the control unit arranged to regulate torque generated by the actuator on the rotary member on a basis of tension measured by the sensor, the tension being able to be greater or less than that under which the wire unwinds from the corresponding spool;

the control unit having or cooperating with a memory containing tension data related to a wire feed value measured independently by the feeder device, the control unit cooperating with the memory; and and wherein the control unit determines said feed value by using at least one parameter selected from the group consisting of the wire feed quantity fed by the device and the wire feed velocity, the wire tension being modified on the basis of an operative stage of the processing machine by acting on the rotary member and the actuator.

2. A device as claimed in claim 1, wherein the control unit is interfaced with the processing machine via at least one member of the group consisting of: serial bus, synchronization pulses, and analogue/digital connection, the tension control or rather the definition of the reference value taking place on the basis of the signals originating from the processing machine, said signals relating to different machine operative stages which comprise a metal wire tension which differs from stage to stage.

3. A device as claimed in claim 1, comprising alarm means to be activated whenever the tension regulation, made within a predefined time period, does not bring the measured metal wire tension at least into the region of the predetermined value.

4. A device as claimed in claim 1, wherein the actuator for rotating the rotary member is a motor able to generate a high torque.

5. A device as claimed in claim 1, wherein the actuator is of reversible rotation type, the actuator being able to rotate in one direction or in the opposite direction.

6. A device as claimed in claim 1, comprising a plurality of rotary members and corresponding actuators with which the metal wire cooperates in succession.

7. A device as claimed in claim 1, comprising a compensator member with which the wire cooperates before passing onto the tension sensor, the compensator member being a movable compensator arm hinged to the body, there being associated with the compensator member an elastic member connected at one end to the body of the device and at the other end to a guidedly movable element driven by an actuator subjected to the control and command of the control unit, this control being effected by this latter on the basis of a set value.

8. A device as claimed in claim 7, wherein the set value is a function of the machine operative stage.

9. A device as claimed in claim 7, wherein the set value is a function of the wire tension measured at the exit of the feeder device by the tension sensor.

10. A device as claimed in claim 7, wherein the elastic member is a spring comprising portions of mutually different elastic response.

11. A device as claimed in claim 7, wherein a position of the compensator arm is programmable, the position being scheduled within a predefined angular sector.

12. A device as claimed in claim 7, wherein a position of the compensator arm is programmable on the basis of the machine operative stage.

13. A device as claimed in claim 7, wherein the position of the compensator arm is controlled by another actuator acting independent of the wire working tension.

14. A device as claimed in claim 1, the processing machine being a winding machine.

15. A device as claimed in claim 1, the control unit being of microprocessor type arranged to regulate the torque generated by the actuator on the rotary member on the basis of the tension measured by said sensor.

* * * * *